US005085233A

United States Patent [19]

Motoori et al.

[11] Patent Number: 5,085,233

[45] Date of Patent: Feb. 4, 1992

[54] WIG HAVING COLORLESS CAMOUFLAGE ROOT PORTIONS

[75] Inventors: Nobumoto Motoori; Kousuke Mochizuki, both of Tokyo, Japan

[73] Assignee: Aderans Co., Ltd., Tokyo, Japan

[21] Appl. No.: 450,479

[22] Filed: Dec. 14, 1989

[30] Foreign Application Priority Data

Dec. 29, 1988 [JP] Japan ..... 62-170231[U]

[51] Int. Cl.[5] ..... A41G 5/00

[52] U.S. Cl. ..... 132/54; 132/53

[58] Field of Search ..... 132/200, 201, 53, 54, 132/56; 434/94; 623/15

[56] References Cited

U.S. PATENT DOCUMENTS

| | | | |
|---|---|---|---|
| 1,845,380 | 2/1932 | Westmore | 132/53 |
| 2,789,567 | 4/1957 | Jacoby | 132/53 |
| 3,077,891 | 2/1963 | Lane | 132/201 |
| 3,435,831 | 4/1969 | Nakayama | 132/53 |
| 3,566,889 | 3/1971 | Cole et al. | 132/53 |
| 3,606,894 | 9/1971 | Servino | 132/53 |
| 4,202,359 | 5/1980 | Clifton et al. | 132/201 |
| 4,214,033 | 7/1980 | Clifton et al. | 132/53 |
| 4,302,491 | 11/1981 | Papageorgiou | 132/201 |
| 4,509,539 | 4/1985 | Alfieri | 132/53 |
| 4,739,777 | 4/1988 | Nelson | 132/53 |
| 4,799,502 | 1/1989 | Kobayashi et al. | 132/53 |

FOREIGN PATENT DOCUMENTS

| | | | |
|---|---|---|---|
| 0152220 | 8/1985 | European Pat. Off. . | |
| 0224881 | 6/1987 | European Pat. Off. . | |
| 8905104 | 6/1989 | PCT Int'l Appl. . | |
| 637313 | 5/1950 | United Kingdom | 132/53 |
| 1411241 | 10/1975 | United Kingdom . | |

*Primary Examiner*—John J. Wilson
*Assistant Examiner*—Frank A. LaViola
*Attorney, Agent, or Firm*—Nixon & Vanderhye

[57] ABSTRACT

In a wig, a wig base is made of an artificial skin and/or a net. A plurality of hairs are planted to an outer convex surface of the wig base. The hairs are inconspicuous in color with respect to the wig base, at root areas of the hairs which are planted to the wig base. Thus, knots of the hairs planted to the wig base are inconspicuous so that there is provided a natural hairline.

13 Claims, 6 Drawing Sheets

WIG HAVING COLORLESS CAMOUFLAGE ROOT PORTIONS

BACKGROUND OF THE INVENTION

The present invention relates to a wig in which a hairline can be viewed naturally and in which root areas of hairs planted to a wig base are inconspicuous.

Normally, a wig including a whole wig or a hair piece or a toupee comprises a wig base having an outer convex curved surface in the form of a user's head, and a plurality of hairs mounted to the wig base. The hairs include natural hairs and/or artificial hairs. The wig base is normally made of a net or network formed by nylon filaments, polyester filaments or the like, or an artificial skin formed by soft synthetic resin such as polyurethane, polycarbonate or the like. Alternatively, the wig base is made of the artificial skin which is arranged on a part of the net, for example, on an area thereof corresponding to a hair-parting area of user's own hairs.

Conventionally, as shown in FIGS. 6(A) through 6(D) of the attached drawings, a plurality of hairs 3 (only one shown) made of natural hairs and/or artificial hairs are fastened to a wig base 2 forming a wig 1, and are fixedly mounted to the wig base 2 such that the hair 3 forms a pair of hair sections 3*c* and 3*c* which project upwardly from a surface of the wig base 2. The wig base 2 made of a soft artificial skin is formed by polyurethane resin, polycarbonate resin or the like. A plurality of pairs of bores 2*a* and 2*a* (only one pair shown) are formed in a resin sheet which forms the artificial skin of the wig base 2. The hair 3 is passed through the pair of bores 2*a* and 2*a* by a hair-planting needle, and is tied to the pair of bores 2*a* and 2*a* at a knot 3*a*.

The wig base made of a net or network is formed by nylon filaments, polyester filaments or the like, and has its construction similar to that illustrated in FIGS. 6(A) through 6(D).

Various method of tying the hairs 3 to the wig base 2 made of the artificial skin are known. The tying method illustrated in FIG. 6(A) is called a single. The tying methods illustrated respectively in FIGS. 6(B), 6(C) and 6(D) are called respectively a pan single, a pan double and a double. The tying methods illustrated in FIGS. 6(A) through 6(D) are also applicable to the wig base made of the net.

Hoewever, the knot 3*a* on the wig base 2 and parts 3*b* of the hair 3 beneath the wig base 2 make a thick ball of string. When the wig 1 is worn by a user, the balls of string at the knots 3*a* are conspicuous through gaps among the hairs 3. Further, the more the hair 3 is tied, the larger and the more conspicuous the ball of string at the knot 3*a* is.

FIG. 7 shows a wig 10 which has been used conventionally. The wig 10 has its wig base 12 which is made of a soft artificial skin. A so-called V-planting is utilized in which a hair 13 is merely passed through a pair of bores 12*a* and 12*a* in the wig base 12 to form a pair of hair sections 13*c* and 13*c*, but is not tied. Since the wig base 12 is not linear or a narrow rectangular form, but is in the form of a sheet, it is unnecessary to tie the hair 13 strongly unlike the above-described net. After planting of the hair 13, the backside of the wig base 12 is coated with resin so that the hair 13 is fixed in position from the backside of the wig base 12. Further, the artificial skin, which forms the wig base 12, is transparent such as colorlessness or semi-transparent such as milk white or the like in order for the artificial skin to expose the color of the user's head skin. Moreover, the artificial skin is formed thin as far as possible in order to lighten the artificial skin, in order to improve fitfeeling and so on. That is, the artificial skin is formed into 0.1 mm to 0.5 mm. Furthermore, the pair of bores 12*a* and 12*a* have a spacing therebetween as narrow as possible. However, the spacing between the pair of bores 12*a* and 12*a* is normally 0.8 mm to 1 mm. Thus, it is not preferable that parts 13*b* of the hair 13, which pass along the backside of the wig base 12, can be viewed linearly from a position of eyes of a third person. Specifically, hairs of dark color such as black are conspicuous.

In case where the hairs are mounted to or attached to the wig base made of the net, various directions or orientations of the hairs attached are suitably selected. Further, various knots of the hairs are also suitably selected in order to strengthen the knots as illustrated in FIGS. 6(A) through 6(D) so as to prevent the same from coming loose.

Specifically, as shown in FIG. 8, a wig 20 comprises a wig base 21 which is made of a net or network having a plurality of filaments 22 (only one shown). Each of the filaments 22 of the wig base 21 is circular in cross-section. Hairs 23 (only one shown) must be tied one by one to each filament 22' which forms the net. For this reason, the hairs 23 are tied double so as not to angularly move as indicated by an arrow R. Accordingly, a knot 23*a* forms a relatively large ball of string. Thus, there is such a problem that the knot 23 is further conspicuous. That is, since the knots 23 are all located outside of the wig base 21, the large balls of string of the knots 23*a* are conspicuous for a third person. Thus, the hairs 23 planted are unnatural.

SUMMARY OF THE INVENTION

It is an object of the invention to provide a wig in which, even if a plurality of hairs are mounted to an artificial skin and/or a net forming a wig base, the mounting portions are inconspicuous, and a hairline can be viewed naturally.

For the above purpose, according to the invention, there is provided a wig comprising:

a wig base made of an artificial skin and/or a net, the wig base having an outer convex surface; and a plurality of hairs planted to the outer convex surface of the wig base, wherein the hairs are inconspicuous in color with respect to the wig base, at root areas of the hairs which are planted to the wig base.

According to the invention, the hairs are inconspicuous in color with respect to the wig base, at root areas of the hairs which are planted to the wig base. Since the root areas of the hairs are inconspicuous in color, knots of the hairs planted to the artificial skin and/or the net do not form balls of string which are conspicuous, but form balls of string which are inconspicuous. Thus, the knots cannot easily be viewed.

Further, in case where parts of the hairs pass through the backside of the artificial skin, the hair parts are difficult to be observed through the artificial skin from a position of eyes of a third person, because the hair parts are inconspicuous. Thus, there is provided a natural hairline, and it is not known that the hairs on the user's head are the wig.

Preferably, the hairs are substantially the same in color as the wig base at the root areas of the hairs which are planted to said wig base.

Further, preferably, the hairs are natural hairs, and are decolorized at the root areas of the hairs which are planted to the wig base.

Furthermore, preferably, the hairs are artificial hairs, and are colored into the same color as the wig base, at the root areas of the hairs which are planted to the wig base.

DETAILED DESCRIPTION

An embodiment of the invention will be described in more detail with reference to the accompanying drawings.

Figure 1:
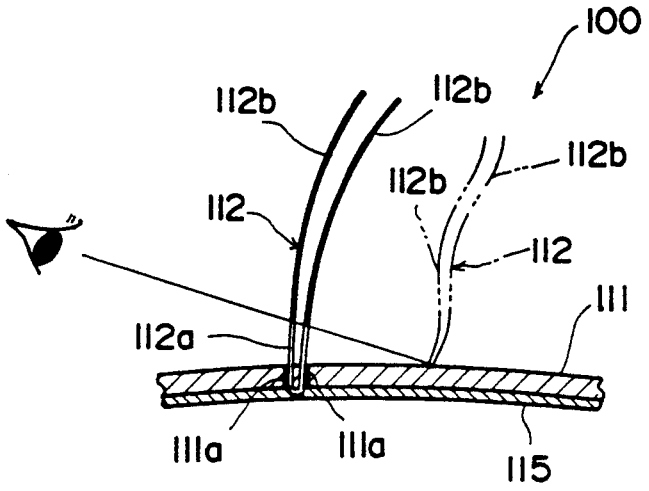
FIG. 1 is a fragmentary cross-sectional view of a wig according to an embodiment of the invention.
Figure 3:
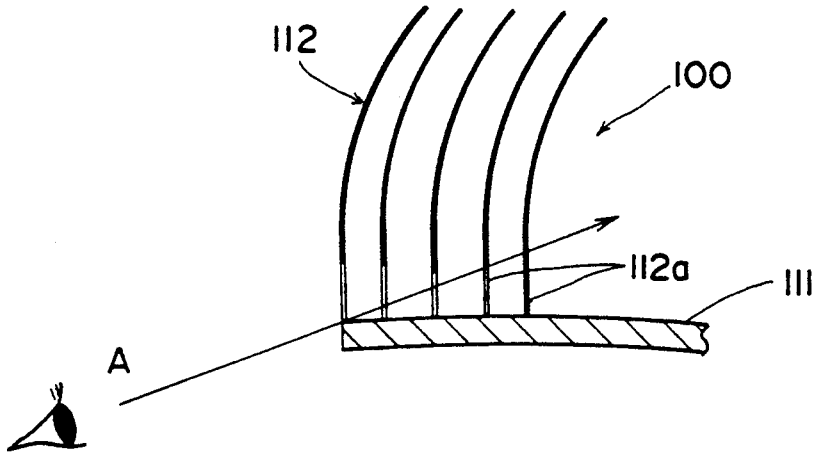
FIG. 3(A) is a fragmentary cross-sectional view showing the neighborhood of a hairline of the wig illustrated in FIG. 2.
FIG. 3(B) is a fragmentary cross-sectional view showing a portion of the hairline of the wig illustrated in FIG. 2 as viewed from a forehead.
Figure 3:
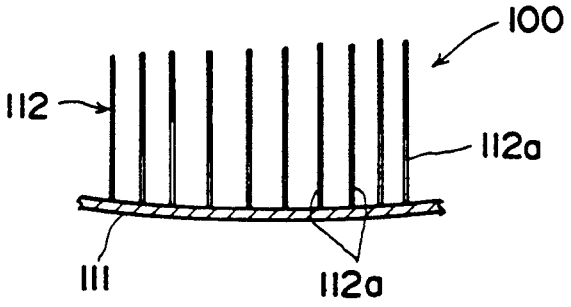

Referring to FIGS. 1, 3(A) and 3(B), there is fragmentarily shown a wig 100 according to an embodiment of the invention. The wig 100 is fundamentally or basically composed of a wig base 111 which is formed in accordance with a user's head configuration. The wig base 111 may be made of an artificial skin and/or a net or network. In the illustrated embodiment, the wig base 111 is made of an artificial skin. The wig base 111 is normally formed soft and thin as far as possible by transparent or semi-transparent polyurethane resin or the like which is colored into a milk white or a flesh color.

Skins have their colors which are different from each other dependent upon a race. Accordingly, when the wig base 111 made of an artificial skin is colored into a flesh color, the wig base 111 is colored in agreement with each of a white man, a black man and a yellow man. For instance, the wig base 111 is colored into pink approximate to white for the white man, into brown approximate to yellow for the yellow man, and into brown or dark brown for the black man.

The net is formed into one which has its suitable meshes by nylon filaments, polyester filaments or the like which are transparent or which are colored into black or flesh color. When the net is colored into a flesh color, the net is colored in agreement with a skin color of each race, similarly to the wig base 111 which is made of the artificial skin. The net is utilized which has its meshes of the order of 15 to 50 per 2.54 cm, for example.

In connection with the above, it is preferable that the wig base 111 made of the artificial skin and/or the net has its color which is approximate to the color of a user's head skin.

A plurality of hairs 112 are planted to the wig base 111 by any suitable planting methods as described previously with reference to FIGS. 6(A) through 6(D) and FIG. 7 in the prior art, for example. Specifically, the hair 112 is passed through a pair of bores 111*a* and 111*a* formed in the wig base 111 and is planted to the wig base 111 to form a pair of hair sections 112*b* and 112*b*. Resin 115 is coated on the backside of the wig base 111 to fixedly mount the hair 112 to the wig base 111. The hairs 112 may be natural hairs and/or artificial hairs made of synthetic fibers. The hairs 112 utilize natural hairs of black, white, gold, red and gray white, or artificial hairs colored into these colors. It is preferable that the hairs 112 are in agreement with color of user's own hairs. In this connection, the hairs 112 may be colorless and transparent.

In the illustrated embodiment, each hair 112 has its substantially central portion which has its length of about 3 mm to 8 mm. The central portion serves as a camouflage portion 112*a* which is colorless or which is the same in color as the wig base 111. The camouflage portion 112*a* is passed through the pair of bores 111*a* and 111*a* in the wig base 111, or is tied thereto so that the camouflage portion 112*a* is fixedly mounted to the wig base 111 by the known V-planting, single planting, pan single planting or the like.

If the wig base 111 is colored into a flesh color, the camouflage portion 112*a* of the hair 112 is also colored in agreement with the color of the skin of each race.

In connection with the above, the camouflage portion 112*a*, which is colorless or which has its color the same as the wig base 111, has its length which is suitably selected dependent upon the type of the wig base 111 or the planting method. Further, parts of the hair 112, which extend between the respective hair sections 112*b* and 112*b* and the camouflage portion 112*a* and which project from the surface of the wig base 111, have lengths of the order of about 1 mm. Each of the parts of the hair 112 serves as a transition area which is colored gradually into a color of the pair of hair sections 112*b* and 112*b* of the hair 112.

If the camouflage portion 112*a* is too long, the hair 112 is viewed so as to come up or float from the head skin, and the hair 112 is viewed unnatural on the contrary. Further, if the camouflage portion 112*a* is too short, parts of the pair of hair sections 112*b* and 112*b* affect the knot so that the knot is conspicuous. Thus, it is necessary that the camouflage portion 112*a* has its length which is not too long and not too short.

Various manufacturing methods of the hairs planted to the wig base of the wig according to the above embodiment of the invention will next be described.

A first manufacturing method will first be described in which the wig base 111 utilizes an artificial skin made of a resin sheet, and the hairs 112 use natural hairs.

Figure 4A:
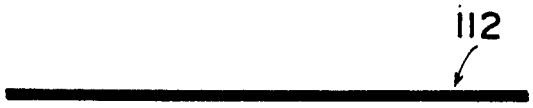
FIGS. 4(A) through 4(C) are views of a manufacturing method of hairs to be mounted to a wig base of the wig according to the embodiment of the invention, FIG. 4(A) showing a natural hair, FIG. 4(B) showing the hair which is decolorized, and FIG. 4(C) showing the hair which is planted.
Figure 4B:
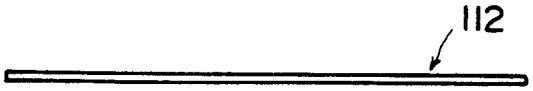

First, the hair 112 shown in FIG. 4(A) is previously decolorized completely by ammonia water, hydrogen peroxide, or the like, as illustrated in FIG. 4(B). Alternatively, the hair 112 is decolorized until it reaches its color substantially the same as the wig base 111.

If the natural hairs 112 decolorized as described above are different in color from the wig base 111, for example, if the wig base 111 is pink, the natural hairs 112 decolorized are dyed into white inclining to pink as a whole. Further, if the natural hairs 112 used are light in color and originally resemble in color the head skin of a wig user, the decolorizing or dyeing treatment or processing is unnecessary.

Subsequently, the decolorized natural hair 112 is planted to the wig base 111. The planting may be the well-known V-planting, single planting, pan-single planting or the like.

Figure 4C:
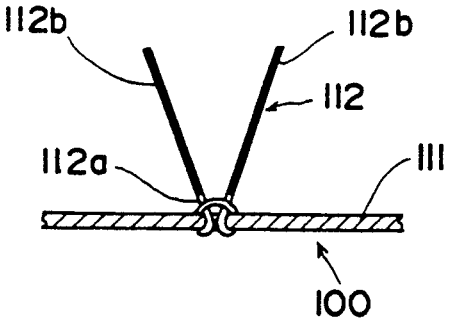

The natural hairs 112, which are brought to the same color as the wig base 111 by the decolorization or the dyeing, are planted to the wig base 111. Subsequently, as shown in FIG. 4(C), the natural hair 112 is dyed in color of the hairs on a user's head, except for the root of the hair 112, to form the pair of hair sections 112*b* and 112*b*. Thus, a wig 100 is completed. The root of the hair 112, which is retained the same in color as the wig base 111, serves as the camouflage portion 112*a*.

A second manufacturing method will next be described in which a net is utilized as the wig base 111 and artificial hairs such as nylon, polyester or the like are used as the hairs 112.

Figure 5:
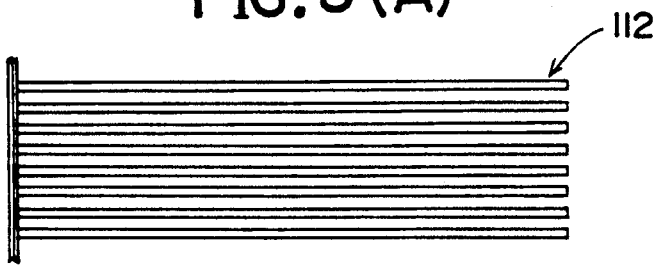
FIGS. 5(A) through 5(D) are views of another manufacturing method of hairs to be mounted to a wig base of the wig according to the embodiment of the invention, FIG. 5(A) showing a bundle of uncolored artificial hairs which is sewn at its end, FIG. 5(B) showing the bundle of uncolored hairs which is dyed in their whole lengths in accordance with a color of the wig base, FIG. 5(C) showing the bundle of hairs having its areas except for its substantially central area, which is dyed in accordance with a color of user's own hairs, and FIG. 5(D) showing the hairs of the bundle which is plated.
Figure 5:
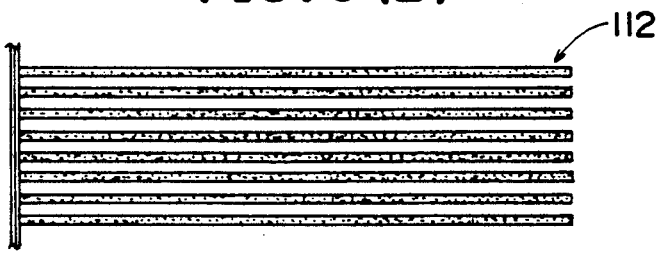
Figure 5:
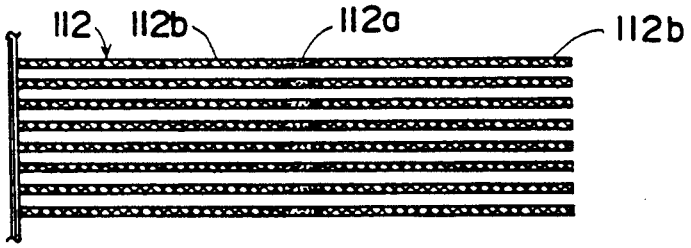
Figure 5:
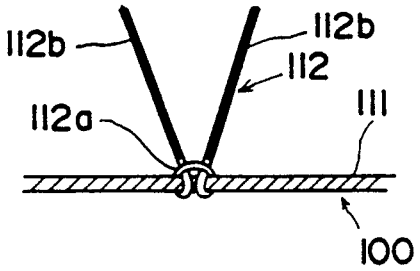
Figure 6:
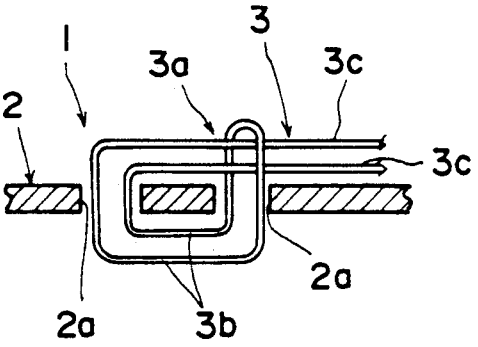
FIG. 6 (A) Prior Art
FIGS. 6(A) through 6(D) are views of examples of conventional various mounting or planting methods of hairs to wig bases, FIG. 6(A) showing a hair planted in a single manner, FIG. 6(B) showing a hair planted in a pan single manner, FIG. 6(C) showing a hair planted in a pan double manner, and FIG. 6(D) showing a hair planted in a double manner.
Figure 6:
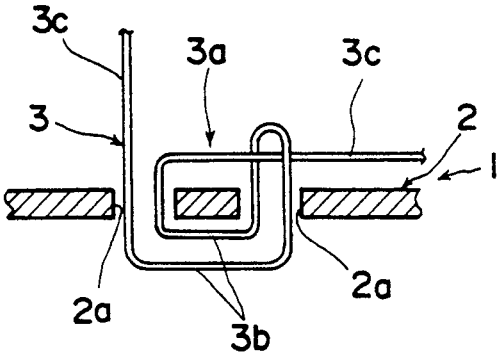
FIG. 6 (B) Prior Art
Figure 6:
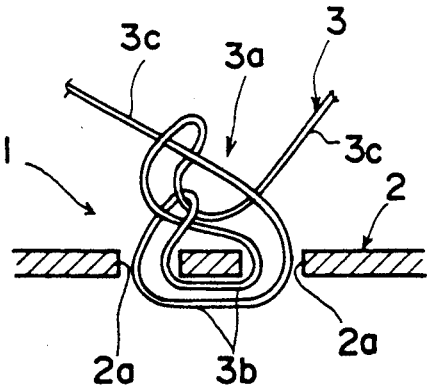
FIG. 6 (C) Prior Art
Figure 6:
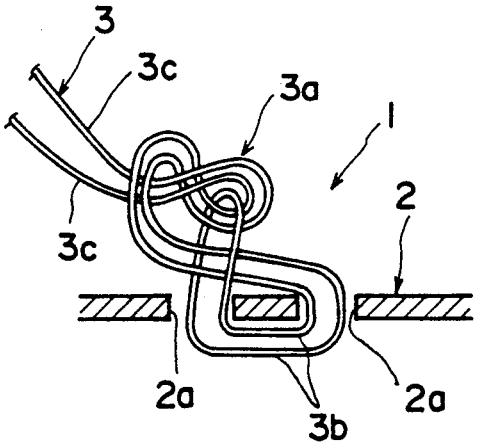
FIG. 6 (D) Prior Art
Figure 7:
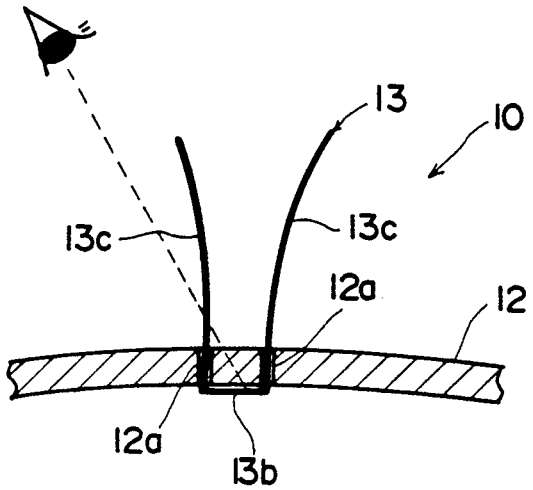
FIG. 7 Prior Art
FIG. 7 is a fragmentary cross-sectional view of another example of a hair planted, in V-planting, to a wig base made of an artificial skin in the conventional wigs.
Figure 8:
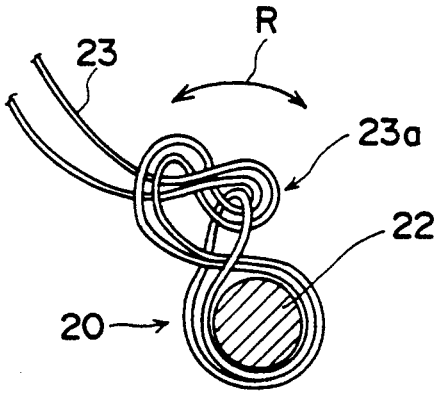
FIG. 8 Prior Art
FIG. 8 is a fragmentary cross-sectional view of still another example of a hair planted to a wig base made of a net in the conventional wigs.

First, as shown in FIG. 5(A), the hairs 112 are bundled up, and a bundle of hairs 112 is sewn at its end by a sewing machine so as not to be disheveled at planting. As shown in FIG. 5(B), the sewn bundle of hairs 112 is colored into the same color as the wig base 111, as a whole, by cationic dyes or the like.

If the artificial hairs 112 utilize hair filaments approximate in color to the wig base 111, the artificial hairs 112 may merely be sewn and bundled up.

Subsequently, as shown in FIG. 5(C), portions of each of the artificial hairs 12 colored into the color of the wig base 111, except for the camouflage portion 112*a*, or portions of each of the artificial hairs 112 remained as they are, except for the camouflage portion 112*a*, are dyed one by one into the color of the hairs on the user's head, leaving 3 mm to 8 mm of a central portion of the artificial hair which serves as the camouflage portion 112*a*. Thus, the artificial hair 112 is formed into the pair of hair sections 112*b* and 112*b*. As shown in FIG. 5(D), the hairs 112 are planted to the wig base 111 such that a knot is formed at the central portion serving as the camouflage portion 112*a*. Thus, the wig 100 is completed.

A third manufacturing method will next be described in which a hair-parting area is formed at the left-hand portion of a wig 100, and a hair whirl is formed slightly to the left in agreement with the hair-parting area. An artificial skin made of a resin sheet is used as a wig base 111. Normal hairs identical in color with user's own hairs are planted to an area of the wig base 111 except for an area of the hair-parting area thereof, along the stream of the hairs on the user's head. Further, hairs 112 decolorized into the same color as the wig base 111 are planted to the hair-parting area of the wig base 111. Subsequently, the roots of the hairs 112 at the hair-parting area are left as camouflage portions 112*a*, while a pair of hair sections 112*b* and 112*b* of the hairs 112 at the hair-parting area are dyed into the same color as the hairs at another area of the wig base 111. Thus, the wig 100 is completed.

A fourth manufacturing method will next be described in which a hair-parting area is formed on the right-hand portion of a wig 100, and a hair whirl is formed slightly to the right in agreement with the hair-parting area. A wig base 111 utilizes a net, and hairs 112 utilize artificial hairs. The hairs 112 are previously bundled up as they are colorless, and are sewn so as not to be disheveled at planting. A pair of portions or a pair of hair sections 112*b* and 112*b* of each of the hairs 112 are dyed one by one into the color of the hairs on the user's head, leaving 3 mm to 8 mm of a central portion of the artificial hair 112 which serves as the camouflage portion 112*a*. The hairs 112 are planted to the wig base 111 such that a knot is formed at the central colorless portion serving as the camouflage portion 112*a*. Thus, the wig 100 is completed.

A fifth manufacturing method will next be described in which a wig 100 of back style is formed. A wig base 111 utilizes an artificial skin made of a resin sheet. Normal hairs identical in color with the user's own hairs are planted to an area of the wig base 111 except for a forehead thereof, along the stream of hairs on the user's head. Hairs 112 decolorized into the same color as the wig base 111 are planted to an area of the forehead. After the hairs 112 have been planted to the wig base 111, the hair sections 112*b* and 112*b* of the hairs 112 at the area of the forehead are dyed into the same color as the hairs at another area, leaving the roots of the hairs 112 which serve as camouflage portions 112*a*. Thus, the wig 100 is completed.

When the hairs 112 of the wig 100 formed in these manners are observed, the following fact is confirmed or known. That is, the camouflage portions 112*a*, which are colorless or which are colored substantially into the same color as the wig base 111, are located at the area of the roots of the hairs 112 which are planted, whereby the camouflage portions 112*a* are assimilated with the wig base 111, and cannot be viewed. Thus, the hair sections 112*b* and 112*b* of the hairs 112, except for the camouflage portions 112*a* thereof, are viewed as hairs grown from the wig base 111 as indicated by the dotted lines in FIG. 1.

Figure 2:
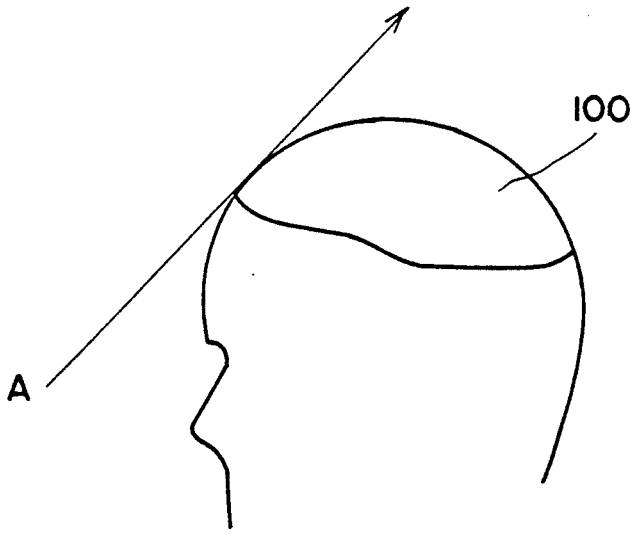
FIG. 2 is a schematic view showing the wig illustrated in FIG. 1, which is worn on a use's head, with hairs omitted.

In this manner, since the head of the user is substantially spherical, the lengths of the camouflage portions 112*a* at the area of the roots of the hairs 112 cannot be viewed uniformly, if, particularly at the hairline, the wig base 111 is observed at such an angle that the wig base 111 cannot be viewed as indicated by the character A in FIGS. 2 and 3(A). Accordingly, a line at the hairline is not linear. Thus, as shown in FIGS. 3(A) and 3(B), the line at the hairline is observed as a natural line.

What is claimed is:

1. A wig comprising;

a wig base having an outer convex surface, and formed of at least one material selected from the group consisting of synthetic skin and net;

a plurality of hairs planted to said outer convex surface of said wig base, wherein each of said hairs has a pair of hair sections and a colorless camouflage portion located between said pair of hair sections, said camouflage portion being fixedly mounted to said wig base.

2. The wig according to claim 1, wherein said wig base is formed substantially in agreement with a configuration of a user's head.

3. The wig according to claim 1, wherein said wig base is formed of the synthetic skin which is made of one of transparent resin and semitransparent resin.

4. The wig according to claim 3, wherein said resin is colored into one of milk white and flesh color so that said resin is semitransparent.

5. The wig according to claim 1, wherein said wig base is made of the synthetic skin, and wherein said wig base is colored into flesh color in agreement with a color of a race.

6. The wig according to claim 1, wherein said wig base is made of the net, and wherein said net is made of resinous filaments which are transparent.

7. The wig according to claim 1, wherein said wig base is made of the net, and wherein said net is made of resinous filaments which are colored into flesh color in agreement with a color of a race.

8. The wig according to claim 1, wherein said wig base is made of the net, and wherein said net has its meshes of the order of 15 to 50 per 2.54 cm.

9. The wig according to claim 1, wherein said wig base has its color which is approximate to a color of a head skin of a user.

10. The wig according to claim 1 wherein said hairs are selected from the group consisting of natural hairs and artificial hairs.

11. The wig according to claim 10, wherein said hairs have their color which is substantially in agreement with that of user's own hairs.

12. The wig according to claim 1, wherein said hairs are natural hairs, and are decolorized at the root areas of said hairs which are planted to said wig base.

13. The wig according to claim 1, wherein said wig base is colorless in a manner substantially identical to said colorless camouflage portion of said hairs.

* * * * *